US005309872A

United States Patent [19]

Filippi et al.

[11] Patent Number: 5,309,872

[45] Date of Patent: May 10, 1994

[54] DEVICE FOR OPERATING A VALVE IN AN INTERNAL COMBUSTION ENGINE

[75] Inventors: Renato Filippi, Vinovo; Francesco Vattaneo, Pancalieri, both of Italy

[73] Assignee: Centro Ricerche Fiat Societa' Consortile Per Azioni, Turin, Italy

[21] Appl. No.: 75,819

[22] Filed: Jun. 11, 1993

[30] Foreign Application Priority Data

Jun. 19, 1992 [IT] Italy ..... 000525 A/92

[51] Int. Cl.[5] ..... F01L 1/34; F01L 1/08

[52] U.S. Cl. ..... 123/90.15; 123/90.16; 123/90.17; 123/90.6

[58] Field of Search ..... 123/90.15, 90.16, 90.17, 123/90.27, 90.48, 90.6

[56] References Cited

U.S. PATENT DOCUMENTS

| | | | |
|---|---|---|---|
| 3,272,189 | 9/1966 | Turkish | 123/90.6 |
| 4,424,790 | 1/1984 | Curtil | 123/90.6 |
| 4,538,559 | 9/1985 | Imamura et al. | 123/90.6 |
| 4,878,462 | 11/1989 | Kurisu et al. | 123/90.6 |
| 4,942,854 | 7/1990 | Shirai et al. | 123/90.6 |
| 5,113,813 | 5/1992 | Rosa | 123/90.17 |
| 5,136,887 | 8/1992 | Elrod et al. | 123/90.17 |
| 5,178,105 | 1/1993 | Norris | 123/90.17 |

FOREIGN PATENT DOCUMENTS

| | | |
|---|---|---|
| 0243339 | 10/1987 | European Pat. Off. . |
| 3913530 | 11/1989 | Fed. Rep. of Germany . |
| 1357151 | 2/1964 | France . |
| 2359967 | 2/1978 | France . |

*Primary Examiner*—Tony M. Argenbright
*Assistant Examiner*—Weilun Lo
*Attorney, Agent, or Firm*—Edward D. Manzo

[57] ABSTRACT

The portion of the profile of an asymmetric cam which controls the closure of a valve in an internal combustion engine is steep enough to ensure that, when the engine speed exceeds a threshold value, the valve closes, without contact between the valve and the cam , within a period of time which is substantially fixed as the engine speed varies, so that the angle of the cam upon closure increases with increases in the rate of rotation of the cam. The active surface of a bucket-type tappet interposed between the cam and the valve has a flat portion substantially perpendicular to the line of movement of the tappet and a curved portion which is connected to the flat portion and has a uniform radius of curvature so as to have a convex region facing the cam.

8 Claims, 5 Drawing Sheets

DEVICE FOR OPERATING A VALVE IN AN INTERNAL COMBUSTION ENGINE

DESCRIPTION

Figure 1:
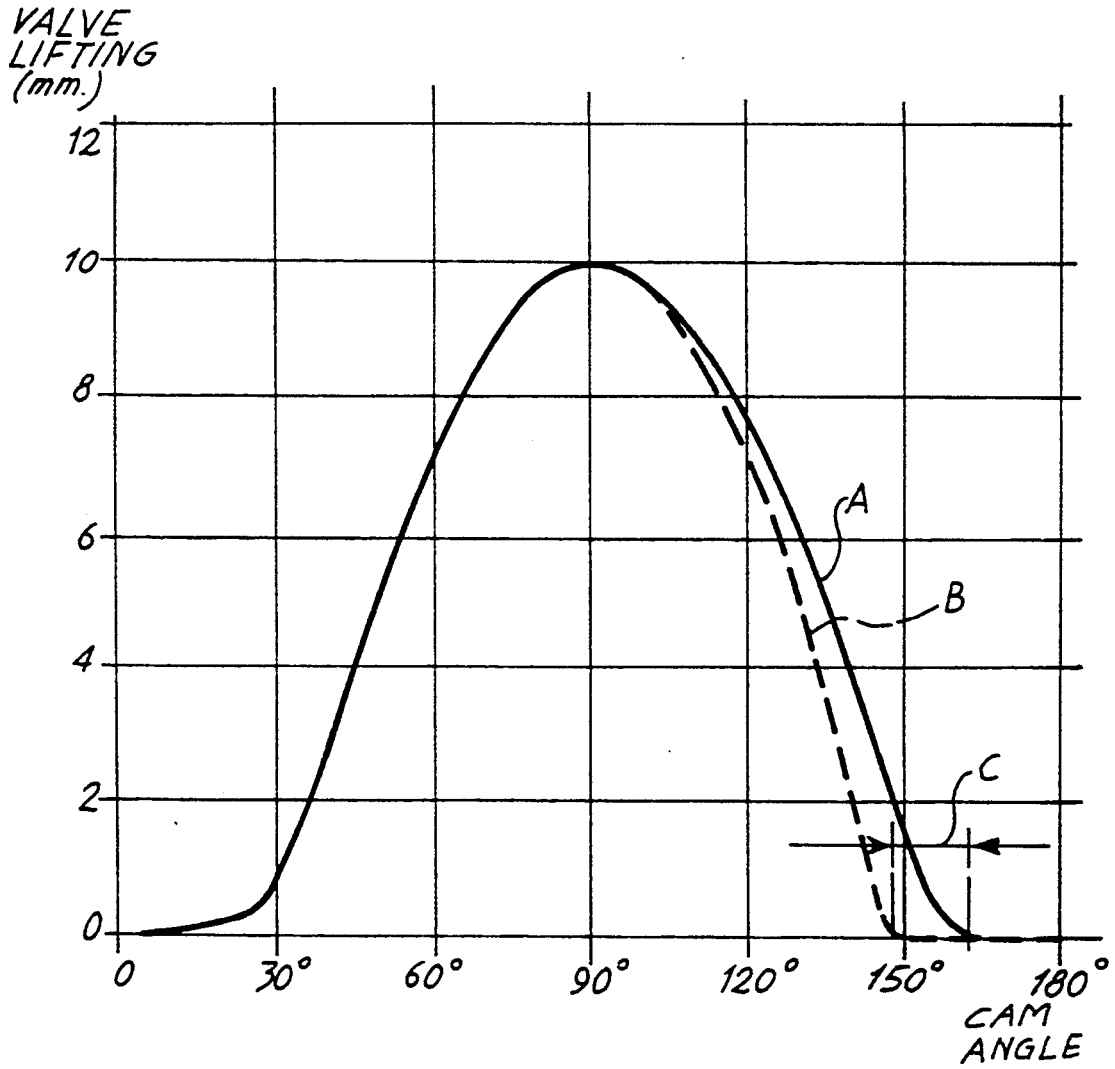
FIG. 1 PRIOR ART

The present invention relates to devices for operating valves in internal combustion engines.

In the design of devices of this type, it is necessary to take account of two conflicting requirements. In internal combustion engines, the charging of the cylinders, and hence also the specific power achievable by the engine, are greatly affected by the angle of rotation of the driving shaft corresponding to the closure movement of the intake valve. In particular, the angle should be quite small at low engine speeds when the inertia of the fluid flowing through the intake ducts is slight and the charging of the cylinders is thus substantially static. Under these conditions, the closure of the intake valves should take place immediately after the piston has reached bottom dead center in order to prevent the charge from flowing back through the intake valve.

With high engine speeds, however, for a number of reasons, the angle of rotation of the driving shaft corresponding to the closure point in the intake phase should be considerably larger than the angle at which the piston reaches bottom dead center (180° from top dead center).

This requirement is particularly important in engines designed for high performance and fast rates of revolution.

Therefore, under maximum torque condition, the optimum angle for the closure of the intake valve at intermediate running speeds should be kept within a range intermediate the optimum angle for full power and the optimum angle for low speeds.

In conventional engines with mechanically-operated valves and fixed timing, the selection of the intake-valve closure angle is thus a compromise depending upon the performance required of the engine.

Naturally, this involves the sacrifice of some of the charge at maximum power in favor of an acceptable torque curve. In high-performance engines, however, the geometry of the intake ducts (particularly their lengths and diameters) is such as to favor charging at fast running speeds. At lower speeds the return wave, which is set up in the intake manifolds, thus tends chronically to occur too much in advance of the envisaged timing of the closure of the intake valves.

This contributes to a considerable lack of torque within a usable range of speeds.

In order to overcome the aforementioned problems, up to now, many devices have been investigated for varying the law governing valve-lift in internal combustion engines, particularly with reference to the need to reduce the intake-valve closure angle as the rate of revolution of the engine decreases.

Devices of a first type provide for arrangements for varying the kinematic law governing the control of the valve, by mechanical, hydraulic or electrical means.

Devices of a second type operate basically by keeping the kinematic law governing the control of the valve unchanged and providing for oil to be drawn off at a suitable moment from a hydraulic intermediary interposed between the tappet and the valve to enable the valve to close earlier than the cam profile would allow.

In any case, in general, the devices proposed up to now are quite complex and expensive and, at times, give rise to the consumption of considerable amounts of energy. In particular, in the case of engines for racing cars, the need to regulate the device extremely rapidly poses problems which are difficult to solve.

The present invention relates in particular to a device for operating a valve in an internal combustion engine, of the type including:

a valve which is movable between a position in which a duct is closed and a position in which the duct is open, resilient means for biasing the valve towards its closure position, valve-operating means for cyclically controlling the movement of the valve towards its opening position against the action of the resilient means, the operating means including a rotary cam with an asymmetric profile including a first portion with an eccentric profile for controlling the movement of the valve towards its opening position and a second portion with an eccentric profile steeper than the eccentric profile of the first portion, for controlling the movement of the valve towards its closure position, and a tappet operatively interposed between the cam and the valve and having an active surface facing the cam, the active surface being engageable by the profile of the cam, at least during the movement of the valve towards its opening position, so that, when the speed of rotation of the cam exceeds a threshold value, the active surface of the tappet loses contact with the cam profile and the closure movement of the valve is therefore unrelated to the rotation of the cam and is completed within a substantially fixed period of time, regardless of the speed of rotation of the cam.

An operating device of the type defined above is known from French patent No. 1,357,151. The device proposed in this patent enables limited automatic adjustment of the rotation angle of the cam at which the closure of the valve takes place with variations in the rate of rotation of the engine, and hence of the cam, but does not enable the valve to be closed quickly enough at slow running speeds and does not therefore enable optimal regulation of the charging of the cylinders under these operating conditions of the engine.

With reference to the appended drawings, the graph of FIG. 1 shows a curve of the valve lift as a function of the rotation angle of the cam, according to the prior art.

The continuous curve A represents the valve lift which can be achieved with a conventional, symmetrical cam profile and the broken line B represents the portion of the closure phase of the valve-lift curve corresponding to a rate of revolution of the engine below or equal to the threshold, which can be achieved by a device produced according to the teachings of the aforementioned French patent. As can be seen, the range of the automatic adjustment which can be achieved in this case, which is that between the curves A and B, is limited to a range, indicated C, of cam angles which corresponds to little more than 10°.

This automatic adjustment value is not sufficient to enable the cylinders to be charged well at all running speeds of the engine.

The object of the present invention is to propose a device for operating a valve in an internal combustion engine which achieves a more extensive automatic adjustment of the valve-closure angle than systems known up to now, so as to enable optimal charging of the cylinders at all running speeds of the engine.

This object is achieved by virtue of the fact that the active surface of the tappet has a first, flat portion substantially perpendicular to the line of movement of the tappet and a second, curved portion which is connected to the first, flat portion and has a uniform radius of curvature so as to have a convex region facing the cam.

By virtue of this characteristic, the device according to the invention achieves very extensive automatic modulation of the valve-closure angle and thus maximizes the charging of the cylinders at all running speeds of the engine, so as to achieve good volumetric efficiency and to optimize the specific power of the engine at all running speeds.

Figure 2:
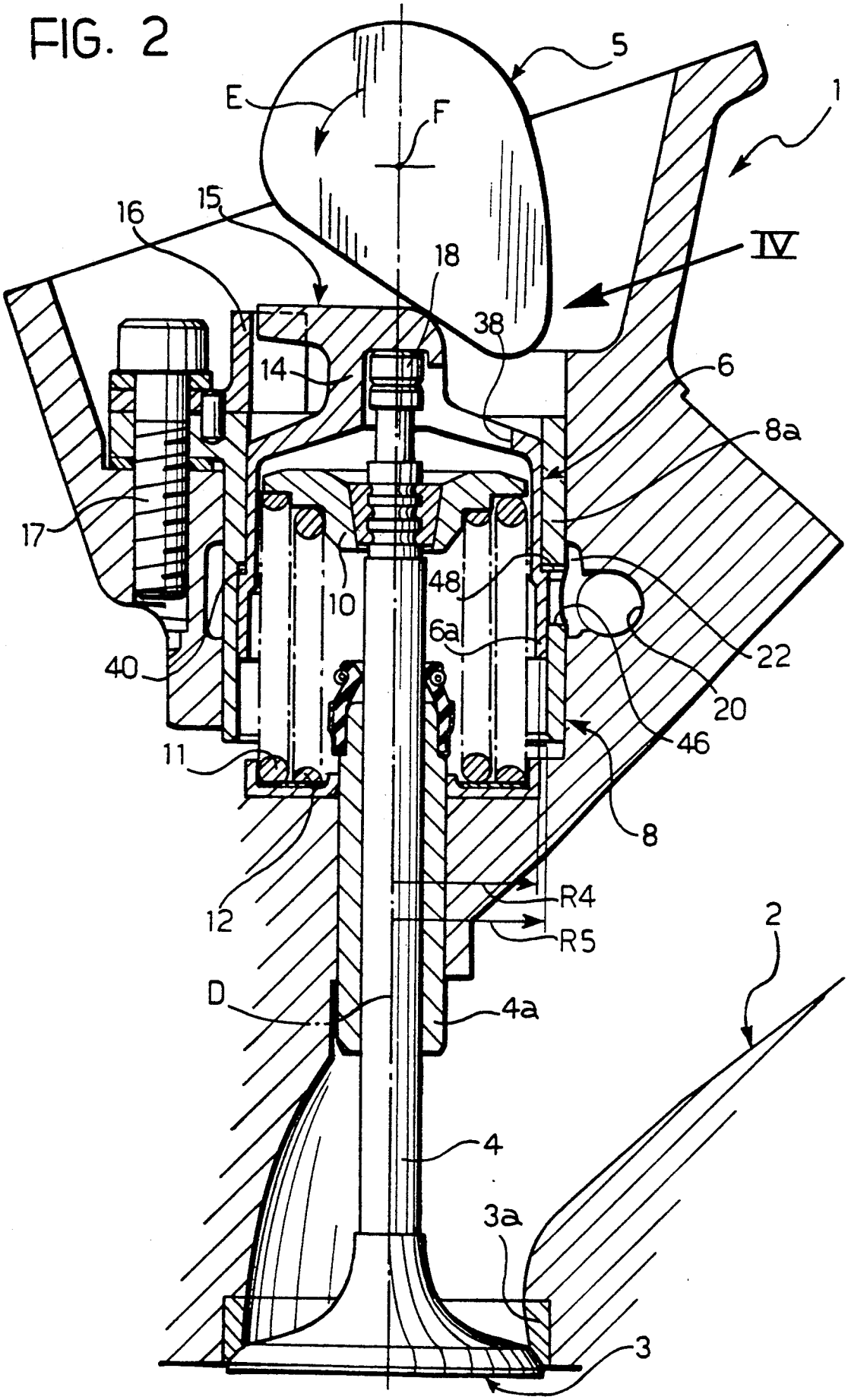
Figure 3:
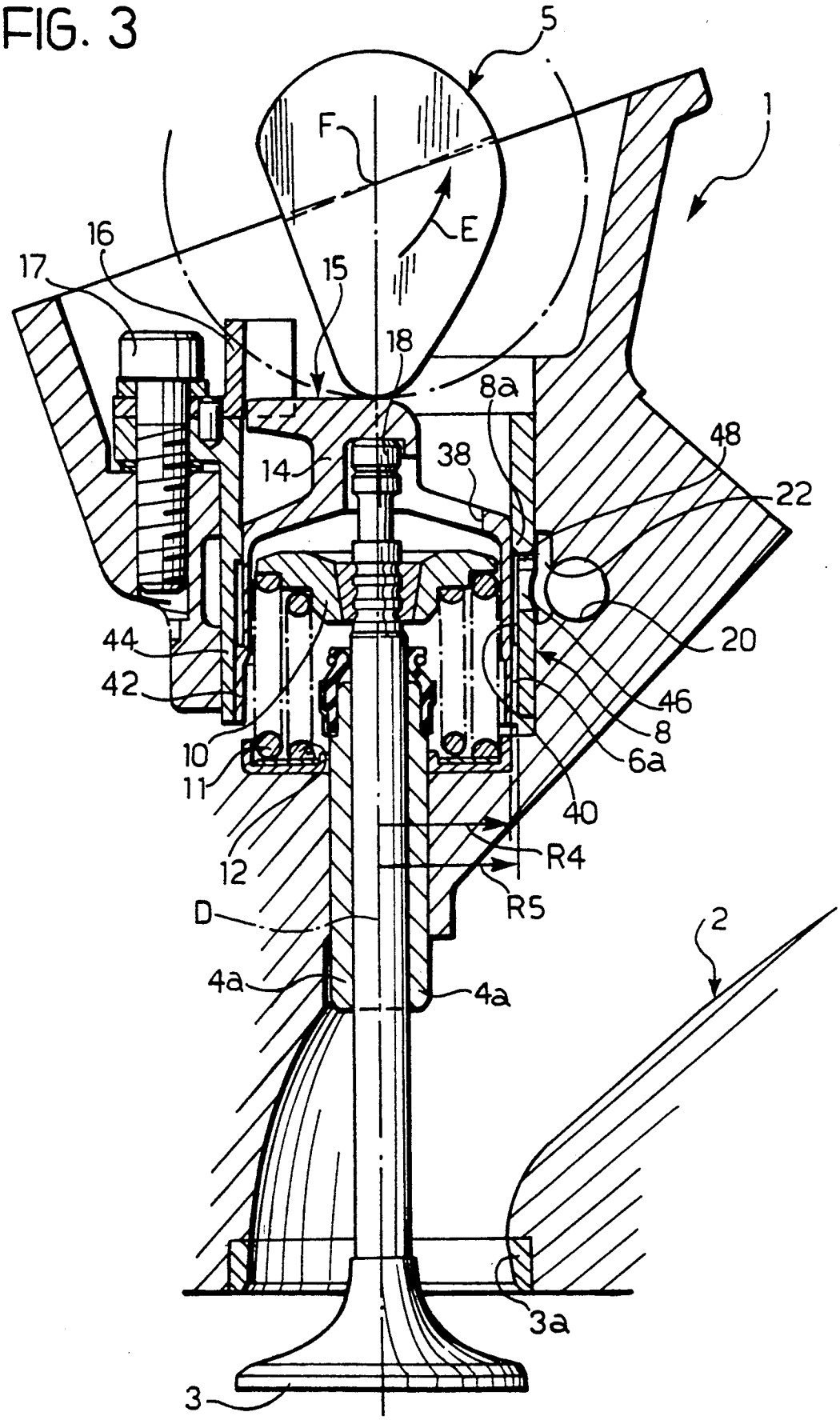
Figure 4:
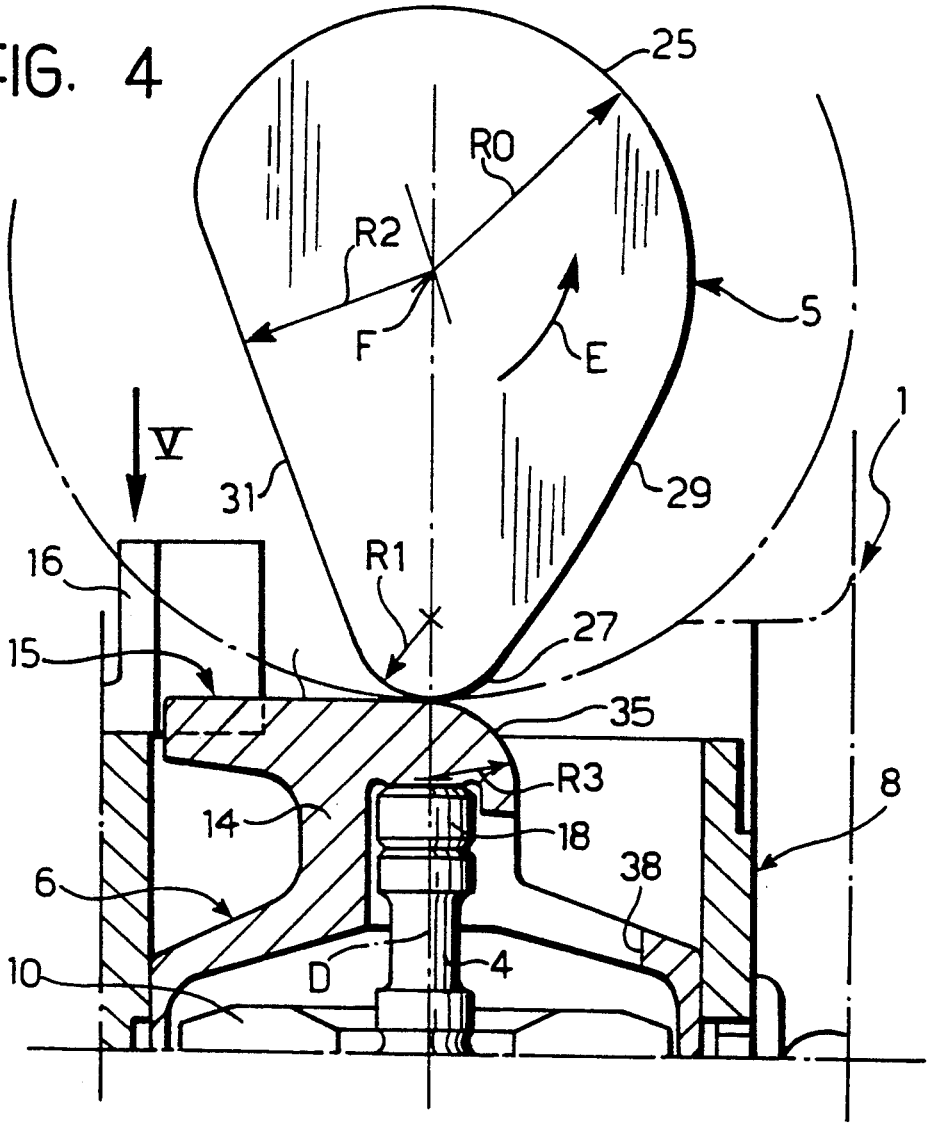
Figure 5:
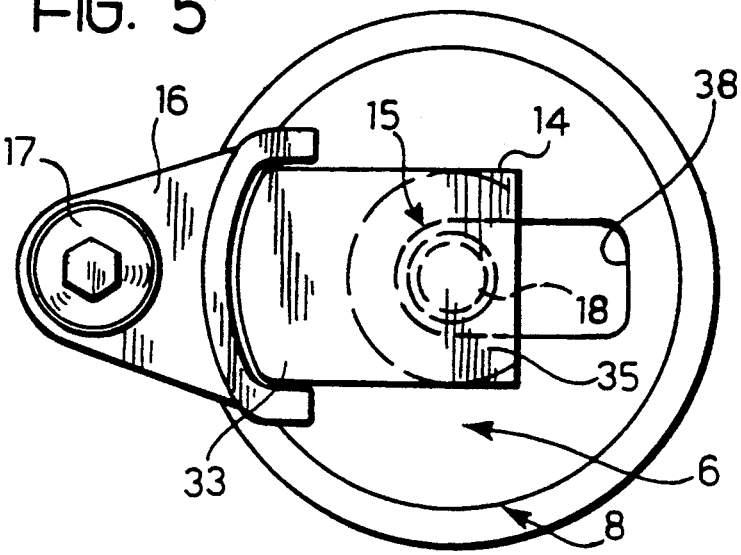
Figure 6:
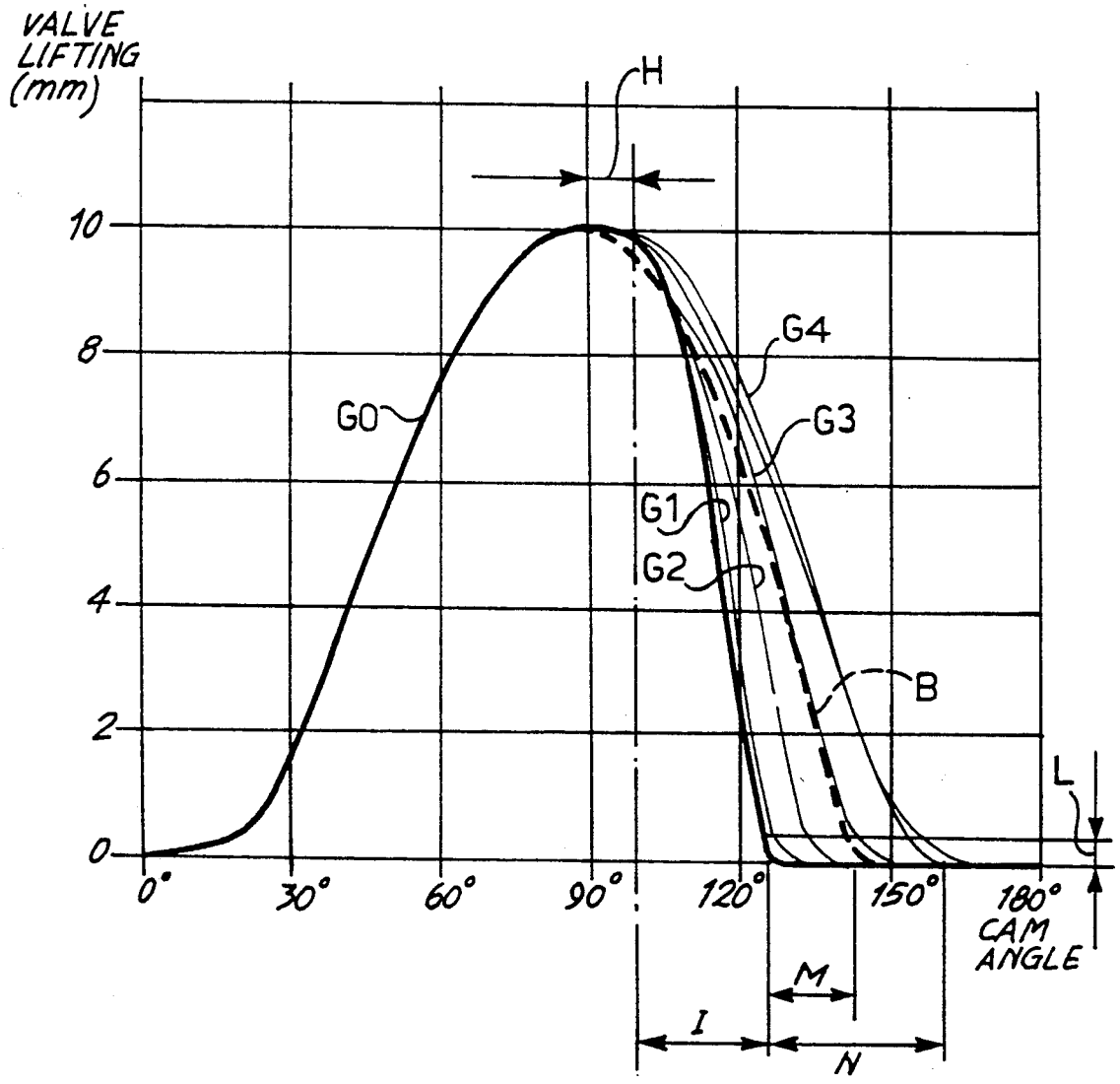

Further characteristics and advantages of the invention will become clear from the description which follows with reference to the appended drawings, provided purely by way of non-limiting example, in which:

FIG. 1 is a graph showing the operating principles of devices formed according to the prior art, FIG. 2 is a partially-sectioned side elevational view of the device according to the invention in the condition in which the valve is closed, FIG. 3 is a view similar to FIG. 2 with the valve in the open position, FIG. 4 shows a detail indicated by the arrow IV in FIG. 2, FIG. 5 is an elevational view of a detail indicated by the arrow V in FIG. 4, and FIG. 6 is a graph showing the operation of the device according to the invention.

With reference to FIGS. 2 to 5, a cylinder head for an internal combustion engine (shown only partially in the drawings) is indicated 1.

An intake duct, indicated 2, is associated with one of the cylinders, and its outlet is controlled by a valve 3 which, in its closure position, bears against a seat 3*a*. The valve 3 has a stem 4 which is movable axially along an axis D in order to open and close the duct 2.

The stem 4 is guided by a sleeve 4*a* of known type, associated with the head 1. The valve 3 is moved cyclically by a cam 5 which is mounted on the camshaft of the internal combustion engine and rotates anticlockwise about the axis F of the camshaft (with reference to the drawings), as indicated by the arrow E.

Between the cam 5 and the end of the stem 4 nearest the cam 5 is a tappet 6 with a substantially bucket-shaped body. The tappet 6 is slidable axially within a bush 8 coaxial with the axis D and connected rigidly to the head 1.

A plate-like member 10 of known type, is fixed axially to the valve stem 4 and is engaged by a pair of concentric helical springs 11 and 12, the function of which is to bias the valve 3 towards the position in which it closes the duct 2.

The tappet 6 includes a head 14 facing the cam 5 and having an active surface 15 for cooperating with the profile of the cam 5. The head 14, which is integral with the tappet 6, is prevented from rotating relative to the bush 8 by a "stirrup-shaped" guide element 16 which is substantially arcuate in plan and of a shape corresponding to that of the adjacent edge of the head 14, and which is rigidly connected to the head 1 by a screw 17 which also has the function of clamping the bush 8.

Between the end of the stem 4 facing the cam 5 and the head 14 of the tappet 6 is a pad 18 which can be replaced to enable fine adjustment of the relative positions of the cam 5 and the tappet 6 (the tappet clearance).

The head 1 has a duct 20 which is supplied with the pressurized oil used for lubricating the engine. The duct 20 is connected to an annular chamber 22 which surrounds the bush 8 and the function of which will become clearer from the following description.

The cam 5 has an asymmetric profile which includes a base portion 25 with a uniform radius of curvature $R_0$ and, at the opposite end, a head portion 27, also with a uniform radius of curvature $R_1$, the center of which is eccentric relative to the axis of rotation F of the camshaft.

Between the base profile portion 25 and the head profile portion 27 of the cam 5 are a portion 29 with a "less steep" profile which controls the movement of the valve as it moves towards its opening position and a portion 31 with a "steeper" profile which controls the movement of the valve towards its closure position. The term "steep profile" used in the present description and in the claims which follow is intended to indicate a profile for which, in a system of polar coordinates, there is a more marked variation of the radial coordinate for a given increase in the angular coordinate. Because of the shapes of the profiles 29 and 31, the opening phase of the valve, that is, the phase in which the valve moves from zero lift to maximum lift involves a greater angular movement of the cam than that necessary to return the valve to its closed position.

In particular, a substantial part of the portion 31 is constituted by a rectilinear profile, tangential to a circle having a radius of curvature $R_2$ which is smaller than the radius of curvature $R_0$ of the base profile portion 25, but which is also centered at F.

The rectilinear profile portion is thus connected at one end to the profile portion 25 and at the other end to the profile portion 27.

The cam 5 cooperates with the active profile 15 of the tappet 6 which includes a first, flat portion 33 substantially perpendicular to the axis D along which the valve stem 4 moves. The profile 33 is connected to a curved profile 35 forming a convex portion facing the cam 5 and having a radius of curvature indicated $R_3$.

The lengths of the radii of curvature $R_0$, $R_1$, $R_2$ and $R_3$ are preferably linked by numerical relationships such that the dimensions of the operating device optimize its operation:

the ratio between the radius of curvature $R_1$ of the head profile 27 and the radius of curvature $R_0$ of the base profile 25 is between 0.1 and 0.4, the ratio between the radius of curvature $R_2$ of the circle to which the "steeper" rectilinear profile of the profile portion 31 of the cam 5 is tangential and the radius of curvature $R_0$ of the base profile 25 is between 0.5 and 0.8.

the ratio between the radius of curvature $R_3$ of the curved portion 35 of the active profile 15 of the tappet 6 and the radius $R_1$ of the head profile of the cam 5 is between 0.8 and 1.2.

The operating device described above is designed so that, when the engine speed exceeds a critical threshold value there is a loss of contact between the cam 5 and the tappet 6 during the closure of the valve.

When the rate of rotation of the engine is below or equal to the threshold value, however, the tappet 6 and, in particular, its active surface 15, remains constantly in contact with the profile of the cam 5.

When the engine speed exceeds the threshold value, the active profile 15 of the tappet 6 loses contact with the profile portion 31 of the cam 5 during the closure of the valve because of the "steepness" of the profile 31 and of the high speed of the cam which, naturally, depends directly upon the engine speed, since the camshaft is driven by the driving shaft. Under these conditions, the law governing the closure of the valve is determined solely by the mass of the movable apparatus, the thrust of the springs 11 and 12 and any inertial and damping effects to which the valve 3 is subject.

Since all the aforementioned effects are independent of the engine speed, it follows that, from the moment when contact between the tappet and the cam is lost, the law governing the return of the valve towards its closure position will also be independent of the engine speed and closure will therefore take place within a time interval which is substantially constant for any engine speed above the speed threshold.

The tappet 6 has a hole 38 in the portion at the base of its head 14. The hole 38 enables the pad 18 to be removed and inserted by means of a suitable tool (not shown in the drawings).

The device according to the invention also has a hydraulic breaking device, the function of which is to slow the travel of the valve during the last portion of its closure phase to prevent abrupt contact between the tappet 6 and the cam profile 5.

The hydraulic braking device comprises a chamber 40 of variable volume which extends between the tappet 6 and the bush 8 and is defined axially by a larger-diameter portion 6*a* of the tappet 6 and, at the opposite end, by a smaller-diameter portion 8*a* of the bush 8. The volume of the chamber 40 varies in dependence on the relative positions of the tappet 6 and of the bush 8.

The chamber 40 has an annular base area concentric with the axis D and defined internally by a circle of radius $R_4$ and externally by a radius $R_5$.

Level with the annular chamber 22, the bush 8 has two sets of radial holes for putting the chamber 22, which is supplied with pressurized oil by means of the duct 20, into communication with the variable-volume chamber 40.

In particular, there are outlet holes 46 and hydraulic braking holes 48, the diameters of the holes 48 being considerably smaller than those of the holes 46. The lengths of the holes 46 are smaller than their diameters, that is, they fulfill the conditions for openings in thin walls so that, as will be explained further below, the leakage of fluid through them has a damping effect which is independent of the viscosity of the fluid used. If this were not the case, the damping effect would be affected by the temperature of the oil, flowing through the holes, which varies with the engine temperature.

The total area of the holes 48 and the total area of the holes 46 are preferably linked to the dimensions of the radii $R_4$ and $R_5$ by numerical relationships such that the dimensions of the hydraulic braking device optimize its functional characteristics; in particular:

the ratio between the total area of the holes 48 and the base surface area of the variable-volume chamber 40 is between 0.002 and 0.016;

the ratio between the total area of the holes 46 and the base area of the variable-volume chamber 40 is between 0.3 and 1.

In operation, when the valve 3 moves from the position in which it closes the duct 2 (FIG. 2) to the position in which it opens the duct 2 (FIG. 3), pressurized fluid passes from the annular chamber 22 to the variable-volume chamber 40 as a result of the change in the volume of the chamber 40 due to the relative movement of the tappet, and hence of its enlarged portion 6*a*, relative to the bush 8 and, in particular, to the portion 8*a* thereof. In this condition, the pressurized oil can flow through the holes 46 and 48 and fill the chamber 40. When the valve returns towards its closure position, the volume of the chamber 40 progressively decreases until its enlarged portion 6*a* blocks the holes 46. During the remaining closure travel of the valve, the fluid in the chamber 40 can leak only through the holes 48, producing a damping effect which slows the closure travel of the valve during its last stage, so as to reduce the impact of the tappet 6 against the cam 5 both in operating conditions in which the cam 5 is separated from the tappet 6 and in the slow-running conditions in which the cam 5 and the tappet 6 are constantly in contact.

FIG. 6 is a graph showing the lift of the valve 3 as a function of the rotation angle of the cam 5. The curve $G_0$ represents the valve lift at slow engine speeds corresponding to the operating conditions in which the tappet 6 remains constantly in contact with the profile of the cam 5, and hence to the minimum possible adjustment of the closure of the valve 3. This curve has a substantially flat portion, indicated H, corresponding to the maximum opening of the valve 3 and, immediately afterwards, a very steep portion corresponding to the upward return movement of the valve. This curve can be compared with the curve B, which is again indicated by a broken line in this graph, and which corresponds to the minimum adjustment of the valve closure achievable by a device formed according to the prior art described in the patent FR-1,357,151 cited above. The graph also shows the curve A already shown in FIG. 1, relating to the valve lift obtainable with a cam having a conventional symmetrical profile. As can be seen, the device according to the present invention enables a much wider range of automatic adjustment of the valve closure than can be achieved according to the prior art and the difference, indicated M, in the adjustment of the closure of the valve 3 enables the closure to be advanced by a cam angle of about 20° compared with the prior art. The minimum closure angle achievable, indicated I, is equivalent to about 30° from the maximum valve-lift condition. The range of the valve-lift within which the valve is subject to the braking effect due to the hydraulic brake is indicated L. The graph also shows a series of curves $G_1$, $G_2$, $G_3$ and $G_4$ which correspond to various running speeds of the engine, particularly for increasing rates of rotation. It is clear that the total possible automatic adjustment range, indicated N, is very wide and corresponds to an automatic adjustment of the delay of the valve closure of a cam angle of more than 30°, with automatic variation between slow and maximum engine speeds.

The operating device according to the invention thus provides an effective and simple response both to the requirement for a small valve-closure angle at slow engine speeds and to the need for a large valve-closure angle at high engine speeds with an automatic increase in the closure angle as the engine speed increases above a threshold value.

Naturally, the principle of the invention remaining the same, the details of construction and forms of embodiment may be varied widely with respect to those described and illustrated purely by way of example, without thereby departing from the scope of the present invention.

In particular, the invention could be used to operate either an intake valve or an exhaust valve. Moreover, the shape and number of holes of the hydraulic braking device could differ from those indicated in the present description.

We claim:

1. A device for controlling a valve in an internal combustion engine, of the type including:

a valve which is movable between a position in which a duct is closed and a position in which the duct is open, resilient means for biasing the valve towards its closure position, valve-operating means for cyclically controlling the movement of the valve towards its opening position against the action of the resilient means, the operating means including a rotary cam with an asymmetric profile including a first portion with an eccentric profile for controlling the movement of the valve towards its opening position and a second portion with an eccentric profile steeper than the eccentric profile of the first portion, for controlling the movement of the valve towards its closure position, and a tappet operatively interposed between the cam and the valve and having an active surface facing the cam, the active surface being engageable by the profile of the cam, at least during the movement of the valve towards its opening position so that, when the speed of rotation of the cam exceeds a threshold value, the active surface of the tappet loses contact with the profile of the cam and the closure movement of the valve is therefore unrelated to the rotation of the cam and is completed within a substantially fixed period of time, regardless of the speed of rotation of the cam, wherein the active surface of the tappet has a first, flat portion substantially perpendicular to the line of movement of the tappet and a second, curved portion which is connected to the first, flat portion and has a uniform radius of curvature, so as to have a convex region facing the cam.

2. A device according to claim 1, wherein it includes a hydraulic braking device for slowing the movement of the valve during the last stage of its closure travel.

3. A device according to claim 2, wherein the tappet comprises a bucket-shaped member which is slidable axially in a fixed bush, and in that the hydraulic braking device includes a variable-volume chamber defined between the bucket-shaped member and the bush the variable-volume chamber being constantly in communication with a source of pressurized oil by means of at least one hydraulic braking hole which extends radially through the bush and at least one outlet hole which puts the variable-volume chamber into communication with the pressurized oil source only when the valve is spaced from its closure position.

4. A device according to claim 1, in which the asymmetric cam includes a base profile portion and a head profile portion which have respective uniform radii of curvature and to which the first and second eccentric portions for opening and closing the valve, respectively, are connected, on opposite sides of the axis of rotation of the cam, wherein the ratio between the radius of curvature of the head profile portion and the radius of curvature of the base profile portion is between about 0.1 and 0.4.

5. A device according to claim 4, wherein the second eccentric profile portion includes a portion with a rectilinear profile tangential to a circle having a radius of curvature smaller than the radius of curvature of the base profile portion of the cam, the ratio between the smaller radius and the base radius being between about 0.5 and 0.8.

6. A device according to claim 5, wherein the ratio between the radius of curvature of the curved portion of the active surface of the tappet and the radius of curvature of the head profile portion of the cam is between about 0.8 and 1.2.

7. A device according to claim 3, wherein the cross-section of the variable-volume chamber is uniform along the line of movement of the valve, and in that the ratio between the total area of the at least one outlet hole and the base area of the variable-volume chamber is between about 0.3 and 1.

8. A device according to claim 7, wherein the ratio between the total area of the at least one hydraulic braking hole and the base area of the variable-volume chamber is between about 0.002 and 0.016.

* * * * *